United States Patent [19]

Yarwood et al.

[11] 4,388,962

[45] * Jun. 21, 1983

[54] ELECTROMAGNETIC CASTING METHOD AND APPARATUS

[75] Inventors: John C. Yarwood, Madison; Ik Y. Yun, Orange; Derek E. Tyler, Cheshire, all of Conn.

[73] Assignee: Olin Corporation, New Haven, Conn.

[ * ] Notice: The portion of the term of this patent subsequent to Jun. 19, 1996, has been disclaimed.

[21] Appl. No.: 957,420

[22] Filed: Nov. 2, 1978

[51] Int. Cl.[3] ..... B22D 27/02

[52] U.S. Cl. ..... 164/455; 164/467; 164/487; 164/503; 164/444; 164/414

[58] Field of Search ..... 164/48, 49, 146, 147, 164/250, 251, 4, 89, 443, 444, 348, 414

[56] References Cited

U.S. PATENT DOCUMENTS

| | | | |
|---|---|---|---|
| 3,441,079 | 10/1966 | Bryson | 164/89 |
| 3,467,166 | 9/1969 | Getselev et al. | 164/49 |
| 3,502,133 | 3/1970 | Carson | 164/444 |
| 3,605,865 | 9/1971 | Getselev | 164/250 |
| 3,646,988 | 3/1972 | Getselev | 164/251 |
| 3,702,155 | 11/1972 | Getselev | 164/251 |
| 3,713,479 | 1/1973 | Bryson | 164/89 |
| 3,735,799 | 5/1973 | Karlson | 164/147 |
| 3,741,280 | 6/1973 | Kozheurov et al. | 164/250 |
| 3,773,101 | 11/1973 | Getselev | 164/251 |
| 3,985,179 | 10/1976 | Goodrich et al. | 164/250 |
| 4,004,631 | 1/1977 | Goodrich et al. | 164/250 |
| 4,014,379 | 3/1977 | Getselev | 164/49 X |
| 4,156,451 | 5/1979 | Getselev | 164/49 |

FOREIGN PATENT DOCUMENTS

| | | |
|---|---|---|
| 1157977 | 7/1969 | United Kingdom . |
| 1290758 | 9/1972 | United Kingdom . |
| 1328166 | 8/1973 | United Kingdom . |

OTHER PUBLICATIONS

"Formation of Ingot Surface During Continuous Casting" by Balakhontsev et al., Tsvetnye Met., 8/70, 43, (8), 64–65.

"Continuous Casting with Formation of Ingot by Electromagnetic Field" by Mochalov et al., Tsvetnye Met., 8/70, 43, (8), 62–63.

"Casting in an Electromagnetic Field" by Getselev, Journal of Metals, 10/71, p. 339.

"Alusuisse Experience with Electromagnetic Moulds" by Meier et al., Swiss Aluminium Ltd., Switzerland.

"Direct Chill Casting Process for Aluminium Ingots—A New Cooling Technique" by Bryson, Canadian Metallurgical Quarterly, vol. 7, No. 1, pp. 55–59.

*Primary Examiner*—Kuang Y. Lin

*Attorney, Agent, or Firm*—Paul Weinstein

[57] ABSTRACT

A method and apparatus for electromagnetic continuous or semicontinuous casting of metals and alloys. A variable coolant application system is used to control the rate of heat extraction from the casting to properly position the solidification front at the surface of the casting without otherwise influencing the containment process through modification of the magnetic field.

4 Claims, 2 Drawing Figures

ELECTROMAGNETIC CASTING METHOD AND APPARATUS

CROSS REFERENCE TO RELATED APPLICATIONS

U.S. patent application Ser. No. 921,298, filed July 3, 1978, by Yarwood et al., for "Electromagnetic Casting Method and Apparatus", now U.S. Pat. No. 4,158,379, granted June 19, 1979.

BACKGROUND OF THE INVENTION

This invention relates to an improved process and apparatus for electromagnetically casting metals and alloys particularly heavy metals and alloys such as copper and copper alloys. The electromagnetic casting process has been known and used for many years for continuously and semicontinuously casting metals and alloys. The process has been employed commercially for casting aluminum and aluminum alloys.

PRIOR ART STATEMENT

The electromagnetic casting apparatus comprises a three part mold consisting of a water cooled inductor, a non-magnetic screen and a manifold for applying cooling water to the ingot. Such an apparatus is exemplified in U.S. Pat. No. 3,467,166 to Getselev et al. Containment of the molten metal is achieved without direct contact between the molten metal and any component of the mold. Solidification of the molten metal is achieved by direct application of water from the cooling manifold to the ingot shell.

The cooling manifold may direct the water against the ingot from above, from within or from below the inductor as exemplified in U.S. Pat. Nos. 3,735,799 to Karlson and 3,646,988 to Getselev. In some prior art approaches the inductor is formed as part of the cooling manifold so that the cooling manifold supplies both cooling to solidify the casting and to cool the inductor as exemplified in U.S. Pat. Nos. 3,773,101 to Getselev and 4,004,631 to Goodrich et al.

The non-magnetic screen is utilized to properly shape the magnetic field for containing the molten metal as exemplified in U.S. Pat. No. 3,605,865 to Getselev. A variety of approaches with respect to non-magnetic screens are exemplified as well in the Karlson '799 patent and in U.S. Pat. No. 3,985,179 to Goodrich et al. Goodrich et al. '179 describes the use of a shaped inductor to shape the field. Similarly, a variety of inductor designs are set forth in the aforenoted patents and in U.S. Pat. No. 3,741,280 to Kozheurov et al.

While the above described patents describe electromagnetic casting molds for casting a single strand or ingot at a time the process can be applied to the casting of more than one strand or ingot simultaneously as exemplified in U.S. Pat. No. 3,702,155. In addition of the aforenoted patents a further description of the electromagnetic casting process can be found by reference to the following articles: "Continuous Casting with Formation of Ingot by Electromagnetic Field", by P. P. Mochalov and Z. N. Getselev, Tsvetnye Met., August, 1970, 43, pp. 62–63; "Formation of Ingot Surface During Continuous Casting", by G. A. Balakhontsev et al., Tsvetnye Met., August, 1970, 43, pp. 64–65; "Casting in an Electromagnetic Field", by Z. N. Getselev, J. of Metals, October, 1971, pp. 38–59; and "Alusuisse Experience with Electromagnetic Moulds", by H. A. Meier, G. B. Leconte and A. M. Odok, Light Metals, 1977, pp. 223–233.

In U.S. Pat. No. 4,014,379 to Getselev a control system is described for controlling the current flowing through the inductor responsive to deviations in the dimensions of the liquid zone (molten metal head) of the ingot from a prescribed value.

The invention herein is particularly concerned with the apparatus for applying cooling water to the ingot for solidification. It is known for electromagnetic casting that the solidification front between the molten metal and the solidifying ingot at the ingot surface should be maintained within the zone of high magnetic field strength. Namely, the solidification front should be located within the inductor. If the solidification front extends above the inductor, cold folding is likely to occur. On the other hand, if it recedes to below the inductor, a bleed out or decantation of the liquid metal is likely to result.

It is known in the art of Direct Chill casting in a water cooled mold to utilize a coolant application arrangement wherein the cooling water applied to the mold and ingot is periodically interrupted or pulsed on a cyclic basis. By varying the ratio of water "on" to water "off" time, good control over the rate at which the coolant removes heat from the ingot can be achieved. This pulse cooling process is amply illustrated by reference to U.S. Pat. No. 3,441,079 to Bryson and to an article entitled "Direct Chill Casting Process for Aluminum Ingots—A New Cooling Technique", by N. B. Bryson, Canadian Metallurgical Quarterly, Vol. 7, No. 1, Pages 55–59.

In the above noted prior U.S. patent application Ser. No. 921,298, filed July 3, 1978, there is disclosed an apparatus and process for controlling the position of the solidification front during electromagnetic casting. The process and apparatus disclosed in our prior application utilizes a coolant discharge port arranged to move axially of the ingot independently of the electromagnetic containing and forming system. By moving the discharge port in an axial direction the solidification front is moved correspondingly to adjust its position without modifying the electromagnetic containment field.

SUMMARY OF THE INVENTION

In accordance with the method and apparatus of this invention the position of the solidification front at the surface of the ingot being electromagnetically cast is adjusted by controlling the coolant application to vary the rate at which heat is extracted from the ingot. This is accomplished in accordance with one embodiment by intermittently turning the flow of coolant which is applied to the surface of the ingot on and off. In accordance with another embodiment the coolant supply is servo-controlled to vary the flow rate intermittently in order to properly position the solidification front.

Accordingly, it is an object of this invention to provide an improved method and apparatus for the electromagnetic casting of metals and alloys.

It is a further object of this invention to provide an improved method and apparatus as above for controlling the position of the solidification front.

These and other objects will become more apparent from the following description and drawings.

DETAILED DESCRIPTION OF PREFERRED EMBODIMENTS

Figure 1:
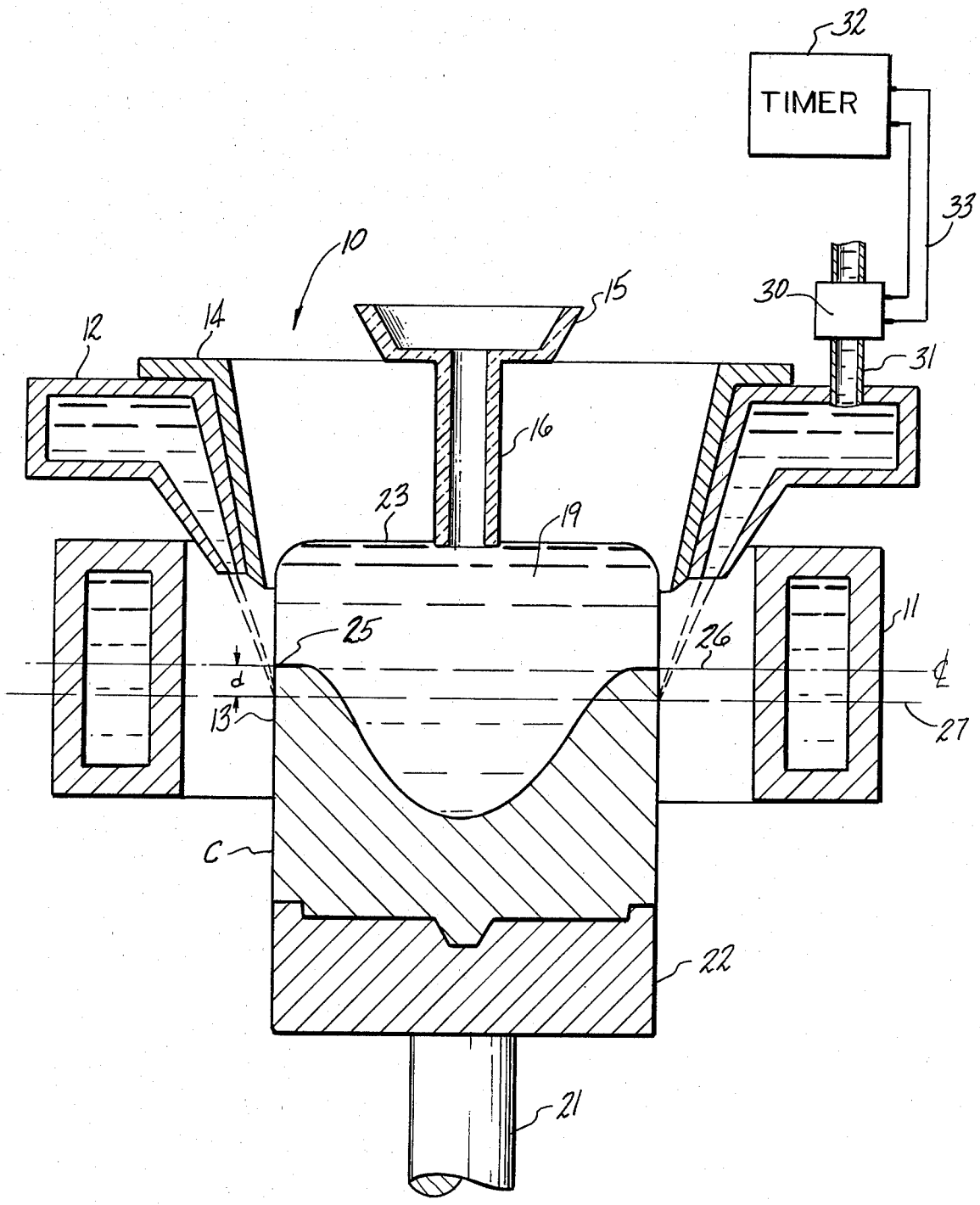
FIG. 1 is a schematic representation of an electromagnetic casting apparatus in accordance with one embodiment of this invention.

Referring now to FIG. 1 there is shown by way of example an electromagnetic casting apparatus in accordance with one embodiment of this invention.

The electromagnetic casting mold 10 is comprised of an inductor 11 which is water cooled; a coolant manifold 12 in accordance with this invention for applying cooling water to the peripheral surface 13 of the metal being cast C; and a non-magnetic screen 14. Molten metal is continuously introduced into the mold 10 during a casting run, in the normal manner using a trough 15 and down spout 16 and conventional molten metal head control. The inductor 11 is excited by an alternating current from a suitable power source (not shown).

The alternating current in the inductor 11 produces a magnetic field which interacts with the molten metal head 19 to produce eddy currents therein. These eddy currents in turn interact with the magnetic field and produce forces which apply a magnetic pressure to the molten metal head 19 to contain it so that it solidifies in a desired ingot cross section.

An air gap exists during casting, between the molten metal head 19 and the inductor 11. The molten metal head 19 is formed or molded into the same general shape as the inductor 11 thereby providing the desired ingot cross section. The inductor may have any desired shape including circular or rectangular as required to obtain the desired ingot C cross section.

The purpose of the non-magnetic screen 14 is to fine tune and balance the magnetic pressure with the hydrostatic pressure of the molten metal head 19. The non-magnetic screen 14 can comprise a separate element as shown, or it may comprise a part of the manifold 12 for applying the coolant as desired.

Initially, a conventional ram 21 and bottom block 22 is held in the magnetic containment zone of the mold 10 to allow the molten metal to be poured into the mold at the start of the casting run. The ram 21 and bottom block 22 are then uniformly withdrawn at a desired casting rate.

Solidification of the molten metal which is magnetically contained in the mold 10 is achieved by direct application of water from the cooling manifold 12 to the ingot surface 13. In the embodiment which is shown in FIG. 1 the water is applied to the ingot surface 13 within the confines of the inductor 11. The water may be applied to the ingot surface 13 from above, within or below the inductor 11 as desired.

The solidification front 25 of the casting comprises the boundary between the molten metal head 19 and the solidified ingot C. It is most desirable to maintain the solidification front 25 at the surface 13 of the ingot C at or close to the plane of maximum magnetic flux density which usually comprises the plane passing through the electrical centerline 26 of the inductor 11. In this way, the maximum magnetic pressure opposes the maximum hydrostatic pressure of the molten metal head 19. This results in the most efficient use of power and reduces the possibility of cold folds or bleed outs.

The location of the solidification front 25 at the ingot surface 13 results from a balance of the heat input from the superheated liquid metal 19 and the resistance heating from the induced currents in the ingot surface layer, with the longitudinal heat extraction resulting from the cooling water application. The location of the front 25 can be characterized with reference to its height "d" above the location of the coolant application plane 27. Hence, the plane of cooling water application 27 can be referenced to the electrical centerline 26 of the inductor. That distance "d" depends on a multiplicity of factors. "d" decreases with increasing: latent heat of solidification of the alloy being cast; specific heat of the alloy; electrical resistivity of the alloy; molten metal head height; inductor height; melt superheat; inductor current amplitude; inductor current frequency; casting speed; and with decreasing alloy conductivity and visa versa.

For a given alloy, the physical properties, latent heat of solidification, specific heat, thermal conductivity, and electrical resistivity are more or less fixed. Normal electromagnetic casting practice would fix the inductor 11 current frequency within limits, the geometrical arrangement of the inductor 11 and its height, the molten metal head 19 height and the inductor 11 current amplitude. It follows, therefore, that the only remaining major process control variable affecting the position of the solidification front 25 at the surface 13 of the ingot C is the casting speed. Therefore, it would be necessary to adjust the casting speed in order to adjust the position of the solidification front 25 to the favorable location corresponding to the plane through the centerline 26 of the inductor 11. However, in practice other factors such as cracking and formation of undesirably coarse microstructures limit the range of casting speeds which can be used.

In accordance with this invention the problem of maintaining the solidification front at its desired position is overcome by controlling the rate at which heat is extracted from the solidifying ingot. This technique allows adjustment of the position of the solidification front 25 location independent of casting speed and alloy properties.

In the embodiment of FIG. 1 a solenoid valve 30 has been inserted in the inlet pipe 31 to the coolant application manifold 12. The solenoid valve 30 is connected to an adjustable timer 32 which actuates it intermittently. The timer 32 and solenoid valve 30 arrangement may be similar to that as described in the Bryson patent and article set forth in the background of this application. The timer 32 and solenoid valve 30 allow discontinuous application of the coolant to the ingot surface 13 which provides intermittent high and reduced levels of heat transfer leading to an overall reduction in the average rate of heat removal from the solidifying ingot C as compared to a continuous flow. This has the effect of retarding the onset of solidification as compared to the continuous application of coolant and thereby lowers the position of the solidification front 25. Any changes in the flow rate or continuity of water application affect the position of the solidification front 25 without influencing the electromagnetic field.

In the apparatus 10 of this invention the coolant is applied directly to the ingot C surface 13 and the ingot never comes in contact with the inductor 11 or coolant application manifold 12. Therefore, by controlling the duration of the periods of the coolant application pulses and the duration of the periods between coolant application pulses one can effectively regulate the rate of heat extraction from the solidifying ingot.

The timer 32 comprises an adjustable timer of conventional design which is arranged to actuate via wires 33 the electrically operated solenoid valve 30 in the input conduit 31 to the coolant application manifold 12. The timer sequentially and repetitively controls the period the valve 30 is open and the period between valve openings when it is closed, to provide intermittent operation of the valve so as to cause the coolant applied to the ingot surface 13 to be pulsed. The respective periods when the valve is open or closed may be set as desired to obtain the desired rate of heat extraction which will properly position the solidification front 25 in the solidifying ingot C.

Figure 2:
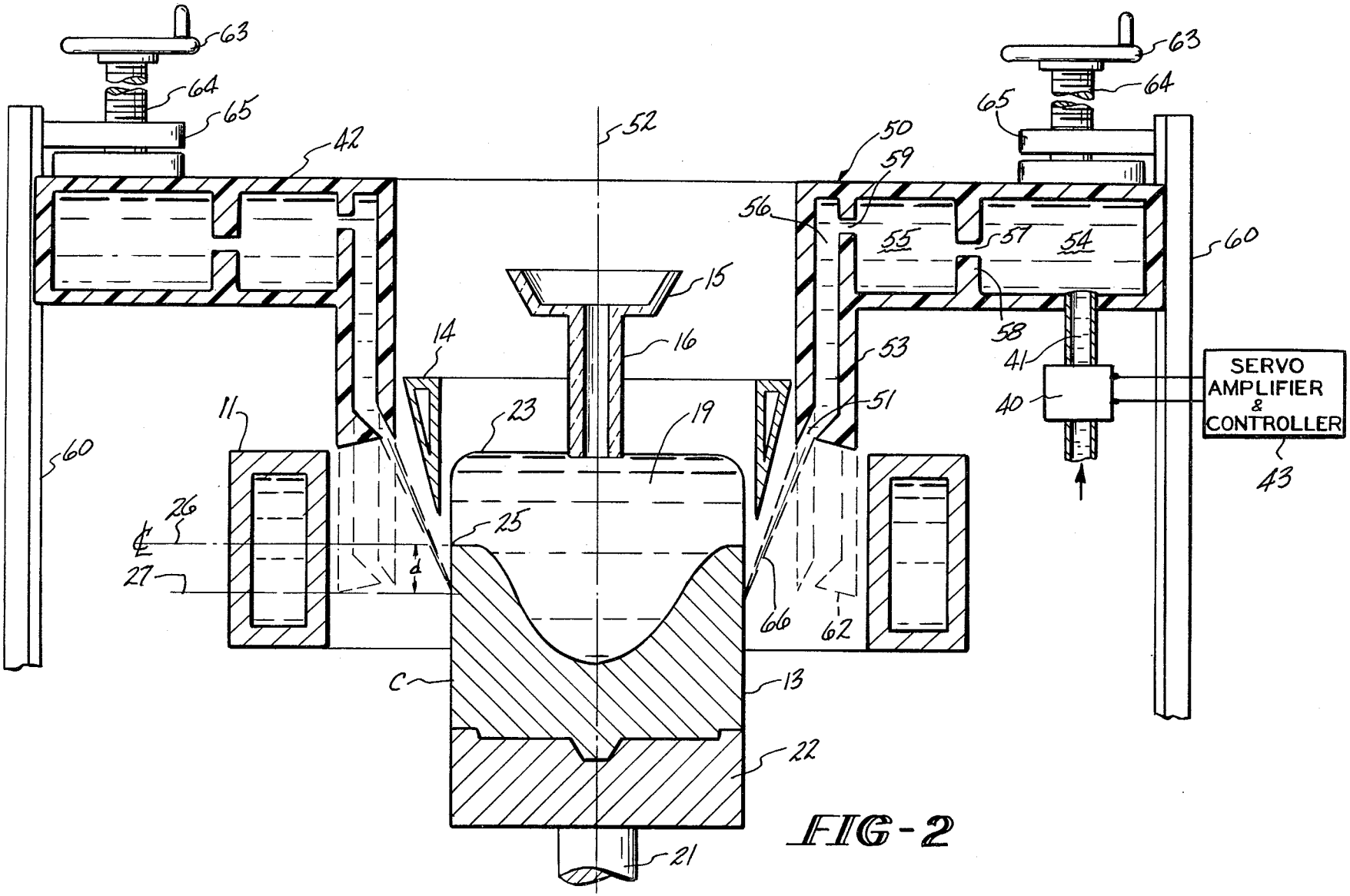
FIG. 2 is a schematic representation of an electromagnetic casting apparatus in accordance with a different embodiment of this invention.

Alternatively, if desired, instead of using an on/off valving arrangement 30 as described by reference to the embodiment of FIG. 1 one could employ an arrangement wherein the pulsed flow of the coolant is provided by intermittently applying two different levels of coolant flow. Referring to FIG. 2 this can be readily accomplished through the use of a servo-controlled valve 40 in the input conduit 41 of the manifold 42 and a conventional servo-amplifier and controller 43 for adjustably controlling the actuation of the valve 40 over its range of actuation between its fully open and fully closed positions. Normally such control for pulse cooling operations would be between valve positions intermediate the fully open and fully closed positions. The servo-amplifier and controller 43 actuate the servo-controlled valve 40 to provide a pulsed output between two different levels of coolant flow. The valve 40 is adapted to rapidly change between its respective high and low coolant flow positions. The respective periods of high and low flow may be set as desired by adjustment of the servo-amplifier 43 to provide the desired heat transfer rate to properly position the solidification front 25.

Therefore, in accordance with this invention means are provided for controlling the position of the solidification front 25 during the electromagnetic casting which comprise adjusting the coolant application means 12 or 42 to provide increased or reduced rates of heat extraction from the ingot C in order to raise or lower the axial position, respectively, of the solidification front. This is accomplished by any of a number of means including the intermittent pulsed application of the coolant or by intermittently changing the flow rate of the coolant in a pulsed manner.

The actual adjustment of the respective periods of on/off operation of the valve 30 or of the periods of high and low flow of the valve 40 usually occurs prior to a casting run. However, if desired, the adjustment may occur during a casting run to correct a mispositioning of the solidification front 25.

In the embodiment of FIG. 2 it is also possible to utilize in conjunction with the solidification front 25 position control system 30 or 40 of this invention the solidification front position control system 50 of our prior application U.S. Ser. No. 921,298, filed July 3, 1978. The use of both systems in conjunction should provide a wider range of adjustment and increase the sensitivity of the adjustment.

In accordance with this embodiment of the invention as shown in FIG. 2 the coolant manifold 42 is arranged above the inductor and includes at least one discharge port 51 for directing the coolant against the surface 13 of the ingot or casting C. The discharge port 51 can comprise a slot or a plurality of individual orifices for directing the coolant against the surface 13 of the ingot C about the entire periphery of that surface.

In order to provide a means in addition to pulse cooling for controlling the solidification front 25 at the surface 13 of the ingot C without influencing the containment of the molten metal through modification of the magnetic field, the coolant manifold 42 with its discharge port 51 is arranged for movement axially of the ingot C. The coolant manifold 42, the inductor 11 and the non-magnetic screen 14 are all arranged coaxially about the longitudinal axis 52 of the ingot C. In the preferred embodiment shown the coolant manifold 42 includes an extended portion 53 which includes the discharge port 51 at its free end. The extended portion 53 of the coolant manifold 42 is arranged for movement between the non-magnetic screen 14 and the inductor 11 in the direction defined by the axis of the ingot C.

The inductor 11 and the non-magnetic screen 14 are supported by conventional means known in the art (not shown). The coolant manifold 42 is supported for movement independently of the inductor 11 and the non-magnetic screen 14 so that the position of the discharge port 51 can be adjusted axially of the ingot without a concurrent movement of the non-magnetic screen 14 or inductor 11. This is a significant departure from the approaches described in the prior art wherein the non-magnetic screen 14 is supported by the coolant manifold 12 and both are arranged for simultaneous movement in the axial sense.

By moving the discharge port 51 of the coolant manifold independently of the non-magnetic screen 14 in accordance with this invention it is possible to adjust the position of the solidification front 25 without modifying the magnetic containment field. In the preferred embodiment shown in FIG. 2 the discharge port 51 is arranged for axial movement between the non-magnetic screen 14 and the inductor 11 along the path 62 as shown in phantom.

Another feature of this embodiment of the present invention is that the coolant manifold or at least that portion of the manifold which enters the magnetic field is formed of a material which will not modify the magnetic field. Preferably, it is formed of a non-conductive material such as plastic or resinous materials including phenolics.

In the embodiment shown in FIG. 2 the coolant manifold 42 includes three chambers 54, 55 and 56. The coolant enters the manifold 42 in the first chamber 54. A slot or a plurality of orifices 57 arranged in the wall 58 between the first chamber 54 and the second chamber 55 serve to enhance the uniformity of the distribution of the coolant in the manifold 42. Similarly, slots or orifices 59 between the second 55 and the third chamber 56 further enhance the uniformity of distribution of the coolant in the manifold 42. The coolant is discharged from the axially extended third chamber 56 via the discharge port 51. The manifold 42 including the extended third chamber 56 is arranged for movement along vertically extending rails 60 so that the extended portion 53 of the manifold can be moved between the inductor 11 and the screen 14 along the path 62 as shown in phantom.

Axial adjustment of the discharge port 51 position is provided by means of cranks 63 mounted to screws 64. The screws are rotatably secured to the manifold 42 at one end and are held in threaded engagement in support blocks 65 which are mounted to the rails 60. In this manner turning the cranks 63 in one direction or the other will move the manifold 42 and discharge port 51 axially up or down.

The coolant is discharged against the surface of the casting in the direction indicated by arrows 66 to define the plane of coolant application. By moving the discharge port 51 up or down in the manner described above the plane of coolant application 27 is also moved up or down respectively with respect to the centerline 26 of the inductor 11 to thereby change the distance "d".

Copper alloy ingots are typically cast in 6"×30" cross sections at speeds at from about 5 to 8" per minute. Over this restricted speed range the preferred and most preferred water application zones for three common copper alloys have been calculated as follows:

TABLE I

| Calculated Water Cooling Application Zone | | |
|---|---|---|
| Alloy | Preferred | Most Preferred |
| C 11000 | $-\frac{1}{2}'' \rightarrow -2''$ | $-\frac{3}{4}'' \rightarrow -2''$ |
| C 26000 | $0 \rightarrow -1\frac{1}{4}''$ | $-\frac{1}{4}'' \rightarrow -1''$ |
| C 51000 | $+\frac{3}{8}'' \rightarrow -\frac{3}{4}''$ | $+\frac{1}{8}'' \rightarrow -\frac{1}{2}''$ |

The measurements provided in Table I are for the distance from the centerline of the inductor to the plane of the coolant application. The values are negative or positive, respectively, depending on whether the plane of coolant application is arranged below or above the centerline of the inductor.

While it is most preferred in accordance with this embodiment of the invention to form the entire manifold 42 from a non-conductive material one could, if desired, form only that portion of the manifold 42 which would interact with the magnetic field from the non-conductive material while using other materials such as metals for the remaining portion of the manifold 42. For example, if desired, only the chamber 56 need be formed from non-conductive material, whereas the chambers 54 and 55 could be formed from any desired material. The chamber 56 would then be joined to the chambers 54 and 55 in a conventional manner. Therefore, in accordance with this embodiment of the invention it is only necessary that the portion of the coolant application means which would interact with the magnetic field be formed from a non-conductive material.

The method of continuously or semicontinuously casting metals and alloys in accordance with this embodiment of the present invention involves the adjustment in an axial sense of the position of the manifold 42 and in particular, the discharge port 51 therein, prior to the beginning of a casting run in order to position the solidification front 25 at an appropriate axial position for the alloy being cast. It is preferred that this adjustment take place prior to the beginning of the casting run. However, if desired, the adjustment can be refined during a casting run. The discharge port 51 must be moved independently of the inductor 11 and screen 14 so that its change in position does not affect the magnetic field or the containment process.

It should be apparent from the foregoing description that as compared to cooling with a continuous full flow, pulse cooling is only effective to lower the solidification front 25. However, in accordance with this invention when operating in a pulse cooling mode within the ranges of the periods of coolant application or non-application or the periods of high or low flow it should be possible to raise or lower the solidification front over a range of positions with the highest position comprising that corresponding to non-pulsed application of the coolant. The embodiment of the invention with respect to FIG. 2 is, therefore, particularly adapted to increase the range of adjustment while using the pulsed coolant application. If it is necessary to raise the solidification front 25 above a maximum level achievable by adjustment of the pulsed cooling, this can be accomplished by raising the position at which the coolant is applied to the ingot surface.

With respect to the embodiment of the invention wherein the pulsed coolant comprises periods of high and low coolant flow it is preferred that the lower flow rate be selected so that a steam film is generated which has the effect of markedly reducing the rate of heat transfer. This embodiment of the invention is particularly preferred because it should provide less abrupt changes in heat transfer at the ingot surface due to the steam film formation. In such a high/low pulsed flow mode heat transfer at the high flow periods is by nucleant boiling; whereas, in the low flow periods heat transfer is by film boiling. This provides marked differences in heat transfer between the pulses of high flow and low flow thereby allowing for the variation in the rate of heat extraction as described above in order to control the position of solidification front 25.

The actual flow rates of the coolant in either of the pulsed cooling embodiments set forth above may be set as desired. They will be a function of a number of variables including the alloy composition; the latent heat of the solidification of the alloy being cast; the specific heat of the alloy; the metal superheat; the casting speed, etc.

The method and apparatus of this invention is particularly adapted to the continuous or semicontinuous casting of metals and alloys. Further details of the apparatus and method of electromagnetic casting can be gained from a consideration of the various patents and publications cited in this application, which are intended to be incorporated by reference herein.

While the invention has been described with reference to copper and copper base alloys it is believed that the apparatus and method described above can be applied to a wide range of metals and alloys including nickel and nickel alloys, steel and steel alloys, aluminum and aluminum alloys, etc.

It is apparent that there has been provided in accordance with this invention an electromagnetic casting apparatus and method which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. In an apparatus for continuously or semicontinuously casting metals comprising:

means for electromagnetically forming molten metal into a desired casting and means for cooling said molten metal to form a shell of said casting by applying coolant directly to said casting; the improvement wherein, said apparatus further includes:

means for controlling the position of a solidification front at the outer surface of said casting, said means for controlling said position of said solidification front comprising means for providing a pulsed flow of coolant from said cooling means for said application directly to said casting, said means for providing said pulsed flow of coolant comprising an electrically operated valve adapted to control the flow of coolant to provide said pulsed flow and means connected to said valve for actuating said valve intermittently to provide said pulsed flow; and said means for controlling said position of said solidification front further including means for changing the position of said means for applying coolant in order to change the position on said casting at which said coolant is applied.

2. In an apparatus as in claim 1 wherein said means for electromagnetically forming said molten metal into said desired casting includes an inductor for applying a magnetic field to said molten metal and a non-magnetic screen means for shaping said magnetic field; and wherein said means for changing the position of said means for applying coolant comprises means for adjustably supporting at least one coolant discharge port for movement in an axial direction between said inductor and said non-magnetic screen means independently of said electromagnetic forming means.

3. In a process for continuously or semicontinuously casting metals comprising:

electromagnetically forming molten metal into a desired casting; and cooling said molten metal to form a shell of said casting by applying coolant with a cooling means directly to said casting; the improvement wherein, said process further includes:

controlling the position of a solidification front at the outer surface of said casting, said controlling step comprising providing a pulsed flow of coolant in said cooling step for said direct application to said casting;

said step of providing said pulsed flow of coolant comprising providing an electrically operated valve adapted to control the flow of coolant and actuating said valve intermittently to provide said pulsed flow; and said step of controlling the position of said solidification front further including changing the position on said casting at which said coolant is applied to said casting by changing the position of said cooling means.

4. In a process as in claim 3 wherein said step of electromagnetically forming said molten metal into said desired casting includes providing an inductor for applying a magnetic field to said molten metal, providing a non-magnetic screen for shaping said magnetic field and applying said magnetic field to said molten metal; and wherein said step of changing the position on said casting at which said coolant is applied to said casting comprises providing at least one coolant discharge port arranged for movement in an axial direction, and adjusting the position of said coolant discharge port without substantially modifying said magnetic field by moving said discharge port between said non-magnetic screen and said inductor and independent thereof.

* * * * *